United States Patent [19]

Shafer

[11] Patent Number: 4,912,783

[45] Date of Patent: Apr. 3, 1990

[54] TOILET LID CLOSING DEVICE

[76] Inventor: Steven E. Shafer, 14 11th St., Edwards AFB, Calif. 93523

[21] Appl. No.: 272,800

[22] Filed: Nov. 18, 1988

[51] Int. Cl.[4] ..... A47K 13/10; E03D 5/04

[52] U.S. Cl. ..... 4/251; 4/250; 16/82; 16/84; 16/DIG. 17; 220/334

[58] Field of Search ..... 4/250, 251; 49/379, 49/386; 220/334, 262, 263; 16/82, 84, DIG. 17

[56] References Cited

U.S. PATENT DOCUMENTS

| | | | |
|---|---|---|---|
| 1,529,656 | 3/1925 | Kornhauser | 4/251 |
| 1,821,027 | 9/1931 | Oya | 4/251 |
| 1,999,971 | 4/1935 | Williamson | 4/251 |
| 2,200,687 | 5/1940 | Bercot | 4/251 |
| 4,426,743 | 1/1984 | Seabrooke | 4/251 |
| 4,551,866 | 11/1985 | Hibbs | 4/251 |
| 4,815,163 | 3/1989 | Simmons | 16/82 |

FOREIGN PATENT DOCUMENTS

| | | | |
|---|---|---|---|
| 3722114 | 1/1988 | Fed. Rep. of Germany | 4/251 |

*Primary Examiner*—Henry J. Recla
*Assistant Examiner*—James G. Barrow
*Attorney, Agent, or Firm*—Jerry T. Kearns

[57] ABSTRACT

A toilet lid closing device for use on toilets of the type having a vertical tank with a flushing lever, a bowl, a seat and an overlying lid pivotally mounted by a hinge pin, has a torsional coil spring received around the hinge pin which biases the lid and the seat to a closed position. A channel shaped bracket has a horizontal mounting surface secured by the toilet seat mounting bolts, with perpendicularly attached parallel support legs for mounting end portions of a pair of dampening cylinders. An adjustment bracket allows independent adjustable positioning of the dampening cylinders. Each of the dampening cylinders has an extensible rod provided with a circumferential groove for engagement with a spring biased locking pin which retains the rod in a extended position. End portions of the extensible rods have journal bearing ends received on mounting pad axles secured to the underside of the lid and the seat. A sheathed cable is operatively connected to each of the locking pins for disengaging the pins from the grooves upon actuation of the flushing lever. A cable actuation bracket is secured on a side wall of the toilet tank and includes a slider mounted for linear reciprocal movement.

10 Claims, 5 Drawing Sheets

TOILET LID CLOSING DEVICE

BACKGROUND OF THE INVENTION

1. Field of the Invention

The present invention relates to toilet lid closing devices, and more particularly pertains to a device for automatically closing a toilet lid and seat upon actuation of a flushing lever. For safety reasons, it is desirable to have the toilet lid and seat in a closed position after use. This prevents small children, pets and household articles from falling into the toilet. Additionally, many women find it aesthetically desirable to have the toilet lid and seat in a closed position. The present invention provides a device which achieves these objectives by automatically closing the toilet seat and lid upon actuation of the toilet flushing lever.

2. Description of the Prior Art

Various types of toilet lid closing devices are known in the prior art. A typical example of such a toilet lid closing device is to be found in U.S. Pat. No. 1,590,298, which issued to R. Landis on June 29, 1926. This patent discloses a toilet lid operating device which utilizes a dampening cylinder actuated by a foot pedal linkage. U.S. Pat. No. 2,092,707, which issued to B. Zulkoski on Sept. 7, 1937, discloses a toilet seat and lid actuating device which utilizes a foot pedal actuated dampening cylinder. U.S. Pat. No. 2,236,466, which issued to G. Cashwell on Mar. 25, 1941, discloses a linkage mechanism for actuating an outhouse toilet cover upon opening or closing the outhouse door. U.S. Pat. No. 3,516,095, which issued to J. Clifton et al. on June 23, 1970, discloses a foot pedal linkage for opening and closing a toilet seat. The device includes a dampening cylinder for lowering the seat at a controlled rate. U.S. Pat. No. 4,491,989, which issued to J. McGrail on Jan. 8, 1985, discloses a device for automatically releasing and lowering a toilet seat and lid when the flushing handle of the toilet is actuated. The device includes a releasable hinge closing mechanism having a spring biased latching lever and a dampening device mounted to the toilet lid, the device being positioned to be engaged by the latching lever. When the latching lever is actuated by the flushing of the toilet, the seat and lid are released and move downwardly in a manner controlled by the dampening device. A latching pawl is located between the lid hinge member and the seat, which couples the seat and lid together when in a raised position so as to be lowered together upon release.

While the above mentioned devices are suited for their intended usage, none of these devices disclose a toilet seat and lid lowering device which utilizes a cable mechanism to release a locking pin from a circumferential groove in an extensible rod of a dampening cylinder. Additionally, none of the aforesaid devices disclose the use of a channel bracket dampening cylinder mounting which may be retrofitted to conventional toilets utilizing existing toilet seat and lid mounting bolts. Additional features of the present invention, not contemplated by the aforesaid prior art devices, includes the provision of L-shaped adjustable brackets for allowing independent positioning of toilet lid and seat dampening cylinders to allow proper operation. Inasmuch as the art is relatively crowded with respect to these various types of toilet lid closing devices, it can be appreciated that there is a continuing need for and interest in improvements to such toilet lid closing devices, and in this respect, the present invention addresses this need and interest.

SUMMARY OF THE INVENTION

In view of the foregoing disadvantages inherent in the known types of toilet lid closing devices now present in the prior art, the present invention provides an improved toilet lid closing device. As such, the general purpose of the present invention, which will be described subsequently in greater detail, is to provide a new and improved toilet lid closing device which has all the advantages of the prior art toilet lid closing devices and none of the disadvantages.

To attain this, representative embodiments of the concepts of the present invention are illustrated in the drawings and are utilized on toilets of the type having a vertical tank with a flushing lever, a bowl, a seat and an overlying lid pivotally mounted by a hinge pin. A torsional coil spring received around the hinge pin biases the lid and the seat to a closed position. A channel shaped bracket has a horizontal mounting surface secured by the toilet seat mounting bolts, with perpendicularly attached parallel support legs for mounting end portions of a pair of dampening cylinders. An adjustment bracket allows independent adjustable positioning of the dampening cylinders. Each of the dampening cylinders has an extensible rod provided with a circumferential groove for engagement with a spring biased locking pin which retains the rod in a extended position. End portions of the extensible rods have journal bearing ends received on mounting pad axles secured to the underside of the lid and the seat. A sheathed cable is operatively connected to each of the locking pins for disengaging the pins from the grooves upon actuation of the flushing lever. A cable actuation bracket is secured on a side wall of the toilet tank and includes a slider mounted for linear reciprocal movement.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet lid closing device which has all the advantages of the prior art toilet lid closing devices and none of the disadvantages.

It is another object of the present invention to provide a new and improved toilet lid closing device which may be easily and efficiently manufactured and marketed.

It is a further object of the present invention to provide a new and improved toilet lid closing device which is of a durable and reliable construction.

An even further object of the present invention is to provide a new and improved toilet lid closing device which is susceptible of a low cost of manufacture with regard to both materials and labor, and which accordingly is then susceptible of low prices of sale to the consuming public, thereby making such toilet lid closing devices economically available to the buying public.

Still yet another object of the present invention is to provide a new and improved toilet lid closing device which provides in the apparatuses and methods of the prior art some of the advantages thereof, while simultaneously overcoming some of the disadvantages normally associated therewith.

Still another object of the present invention is to provide a new and improved toilet lid closing device for automatically closing the toilet lid and seat at a controlled rate upon actuation of the flushing lever.

Yet another object of the present invention is to provide a new and improved toilet lid closing device which may be easily retrofitted to conventional toilets.

Even still another object of the present invention is to provide a new and improved toilet lid closing device which utilizes a channel bracket designed for allowing independent adjustment of toilet lid and toilet seat dampening cylinders.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
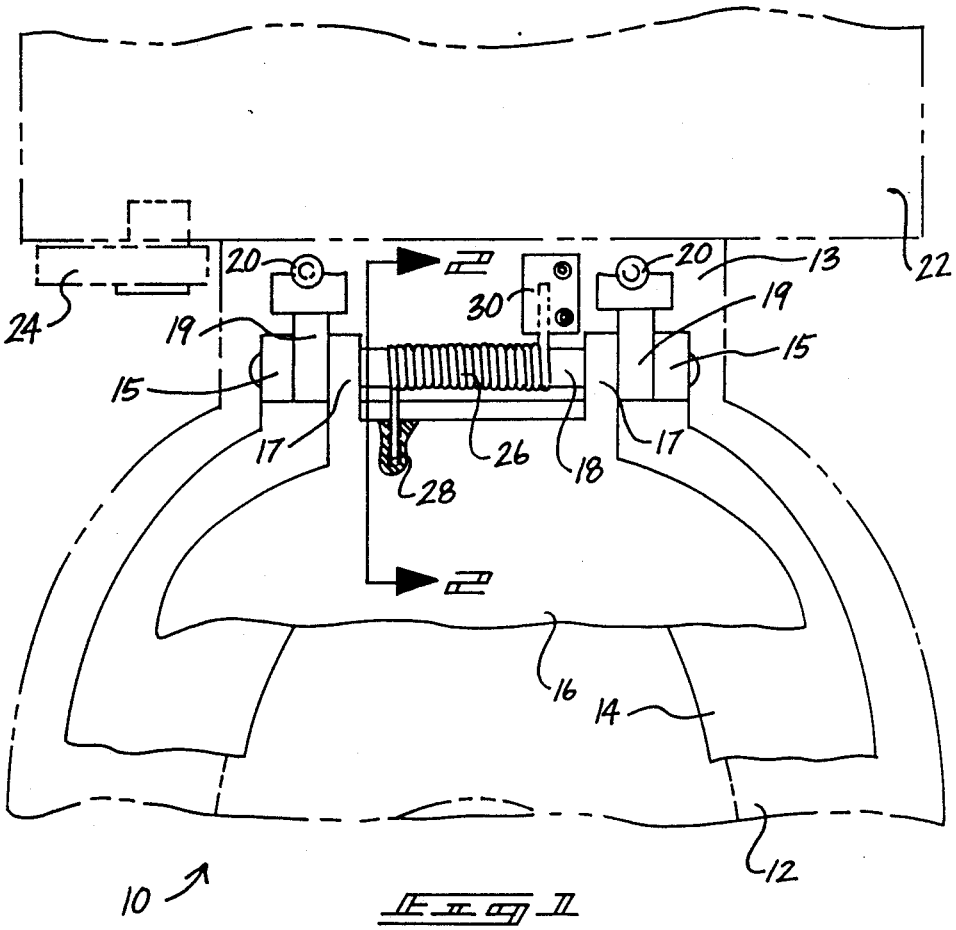
FIG. 1 is a top view, partially cut away, illustrating the torsional spring lid and seat closing mechanism.

With reference now to the drawings, and in particular to FIG. 1 thereof, a new and improved toilet lid closing device embodying the principles and concepts of the present invention and generally designated by the reference numeral 10 will be described.

More specifically, it will be noted that the first embodiment 10 of the invention is utilized on a conventional toilet which includes a bowl 12, a seat 14 and an overlying lid 16. The seat 14 and lid 16 have respective bifurcated yoke portions 15 and 17 which are received for pivotal movement on a hinge pin 18. The hinge pin 18 is mounted on a rear portion 13 of the toilet bowl 12 by mounting tabs 19 secured by bolts 20. This is a conventional construction and forms no part of the present invention. This conventional type of toilet also utilizes a vertically extending tank 22 having a flushing lever 24 projecting from an upper front surface thereof. The present invention employs a torsional coil spring 26 which is received around the hinge pin 18 and has one end secured at 28 to the toilet lid 16 and an opposite end secured at 30 to the rear toilet bowl portion 13. The spring 26 biases the lid 16 and thus the seat 14 to a closed or lowered position.

Figure 2:
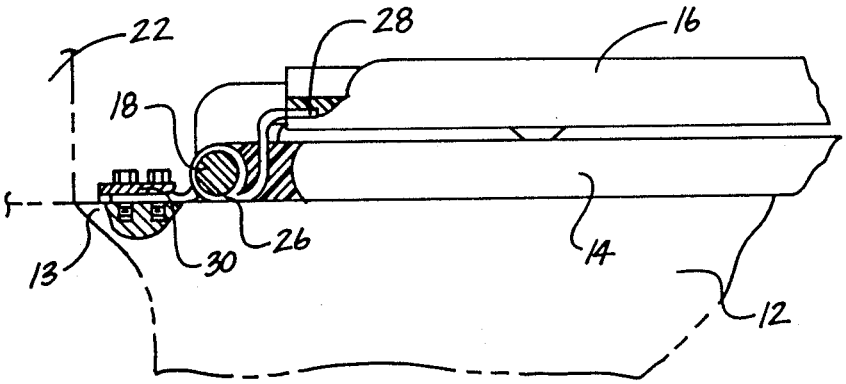
FIG. 2 is a partial cross sectional view, taken along line 2—2 of FIG. 1.

FIG. 2 provides a further illustration of the spring 26 received around the hinge pin 18. The lid 16 and seat 14 are biased to a closed position where they overlie the toilet bowl 12.

Figure 3:
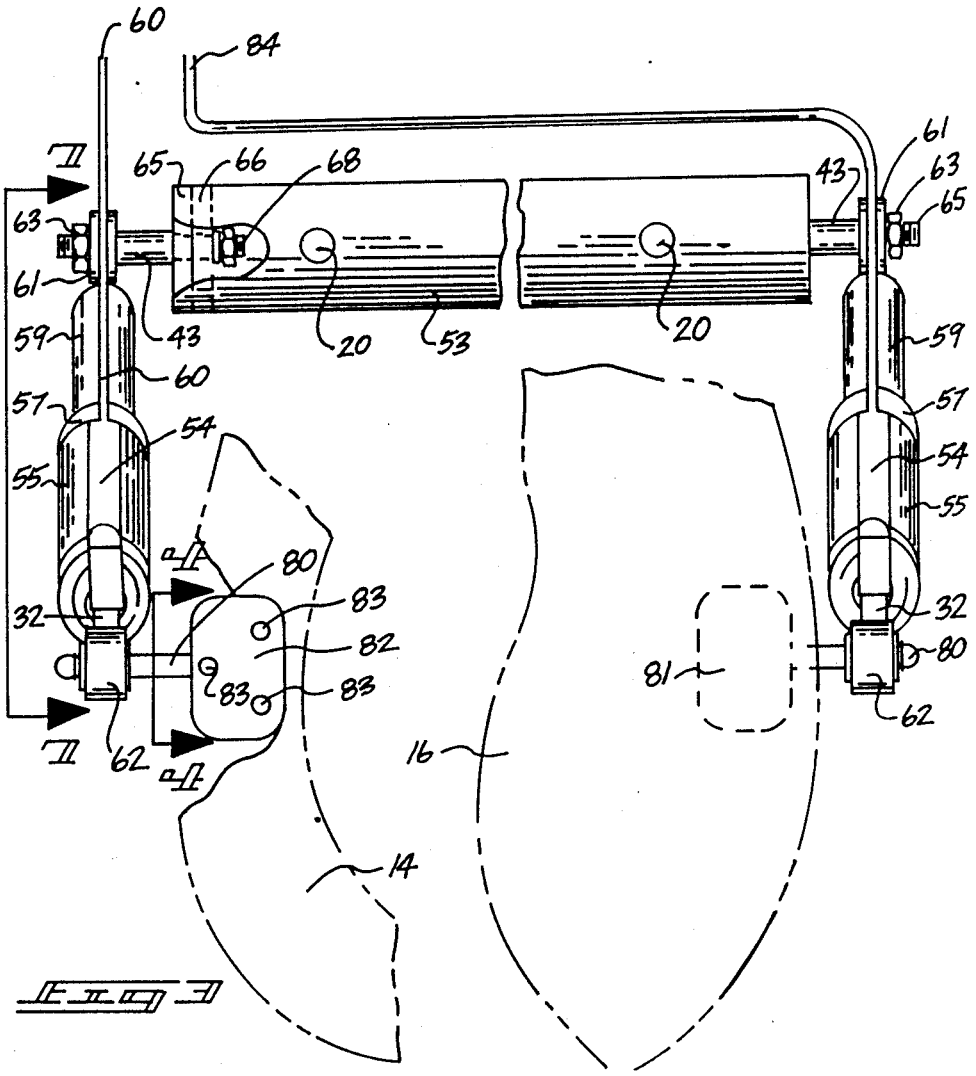
FIG. 3 is a diagrammatic top view, which illustrates the lid and seat dampening cylinders.

FIG. 3 provides a diagrammatic illustration which illustrates the dampening cylinder mechanism utilized in lowering the toilet seat 14 and lid 16 at a controlled rate. A channel bracket has a horizontally extending mounting surface 53 provided with apertures for engagement with the existing toilet lid and seat mounting bolts 20, which secure the toilet lid 16 and seat 14 to the rear portion 13 of the toilet bowl 12, as illustrated in FIG. 1. To install the channel mounting bracket 53, the seat 14 and lid 16 are first removed and the mounting surface 53 is properly positioned. Then, the toilet lid and seat assembly is positioned and reinstalled in overlying relation on the mounting surface 53. The channel bracket 53 has a pair of downwardly perpendicularly extending parallel legs 65, which extend from opposite ends of the horizontal mounting surface 53. Only one of the vertically extending support legs 65 is illustrated in FIG. 3. An L-shaped adjusting bracket 66 is positioned in overlying relation adjacent each of the support legs 65. The construction and usage of the adjustment bracket 66 will be subsequently described in greater detail. A threaded stud 68 extends through aligned apertures in the support leg 65 and adjustment bracket 66. A spindle sleeve 43 is received over the stud 68 and is secured by conventional threaded fasteners such as nuts 63. A journal bearing end 61, attached to a lower end 59 of a dampening cylinder, is received for rotation on the spindle 43. Each dampening cylinder includes a lower portion 59, an upper portion 57 and an extensible rod 32 terminating in a journal bearing end 62. The journal bearing end 62 of each of the dampening cylinders is received for rotation on an axle 80. A first mounting pad 81 is secured on the underside of the lid 16. A second mounting pad 82 is secured on an underside of the toilet seat 14 utilizing conventional fastening means such as screws 83. Screws 83 may be replaced by adhesive fasteners if desired. A locking pin mechanism 54 is provided on each of the dampening cylinders and is operatively connected for actuation with respective control cables 60 and 84. Control cable 60 controls release of the toilet seat 14 and control cable 84 controls release of the toilet lid 16. The locking pin mechanisms 54 are secured on the upper portion 57 of the dampening cylinders through clamping sleeves 55.

Figure 4:
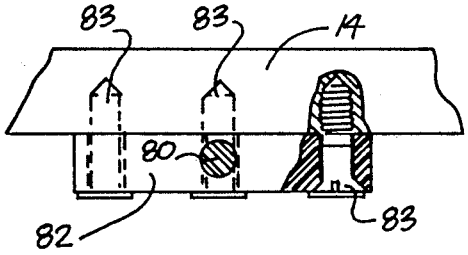
FIG. 4 is a partial cross sectional view, taken along line 4—4 of FIG. 3, which illustrates the toilet seat dampening cylinder mounting pad.

As shown in FIG. 4, the mounting pad 82 is secured by screws 83 which extend into the underside of the toilet seat 14.

Figures 5, 6, 7, 8:
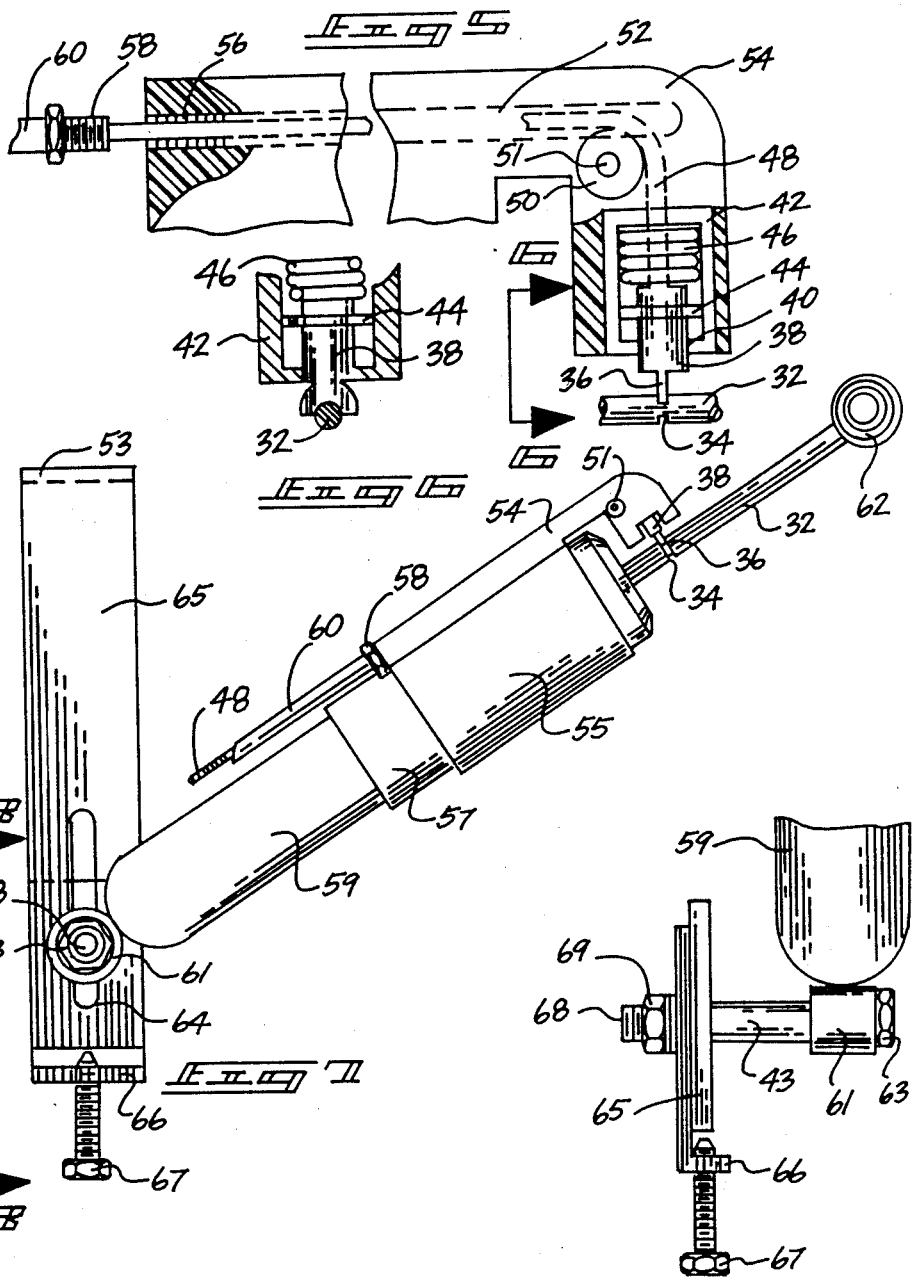
FIG. 5 is a detail view, partially in cross section, illustrating the dampening cylinder locking pin assembly.
FIG. 6 is a partial cross sectional detail view, taken along line 6—6 of FIG. 5, further illustrating the locking pin assembly.
FIG. 7 is a side view illustrating the dampening cylinder adjustable channel mounting bracket.
FIG. 8 is a partial rear view, taken along line 8—8 of FIG. 7, further illustrating the dampening cylinder channel mounting bracket.

FIG. 5 provides a detail view which illustrates the construction of the locking pin mechanisms 54. The body portion 54 is secured, as illustrated in FIG. 3, on the upper portion 57 of each of the dampening cylinders by a clamping sleeve 55. The body portion 54 includes a cylindrical well or sleeve 42 which receives a locking pin 38 for axial reciprocal sliding movement. A coil spring 46 in the well 42 biases the locking pin 38 outwardly. A radial flange 44 on the pin 38 retains the pin 38 within the well 42. The locking pin terminates in a semi circular notched end portion 36, dimensioned for engagement with a circumferential groove 34 in the extensible rod 32 of the dampening cylinder. Thus, as the toilet lid or seat is manually moved to a raised or open position, the portion 36 of the pin 38 will slide into engagement with the groove 34 of the rod 32, thus retaining the toilet lid or seat in an open position. A cable 48, which is preferably formed from nylon, is received for sliding movement within a sheath 60. By tensioning of the cable 48, the portion 36 of the pin 38 is retracted and thus disengaged from the groove 34, thus allowing the seat or lid to move to a closed position under the force of the spring 26 (FIG. 1). The cable sheath 60 terminates in a threaded end portion 58 which is engaged with a threaded bore 56 of the body portion 54. The cable 48 extends through a passage 52 in the body 54 and around an idler roller 50 journaled on an axle 51.

FIG. 6 provides a further illustration of the operative portion 36 of the locking pin 38.

FIG. 7 provides a side view which illustrates the supporting leg 65 of the channel bracket 53. It is to be understood that the opposite side portion is identically formed, and thus need not be further described. The supporting leg 65 is provided with an elongated vertically extending slot 64 through which the stud 68 is received. The slot 64 allows the position of the lower journal bearing end 61 of the dampening cylinder end 59 to be vertically adjusted. An L-shaped adjustment bracket 66 is provided with a circular aperture which receives the stud 68. A stop screw 67 extending through a transverse leg of the bracket 66 is positioned to abut a lower end of the support leg 65.

As shown in FIG. 8, the L-shaped adjustment bracket 66 extends in overlying relation with the support leg 65. Passage of the stud 68 through the vertical slot 64 and through a circular aperture in the vertical leg of the bracket 66 allows the vertical position of the stud 68 to be adjusted by manipulation of the stop screw 67. Conventional threaded fasteners such as nuts 63 and 69 secure the stud 68 in an adjusted position. A spindle sleeve 43 is provided over the stud 68 to provide a smooth bearing surface for the journal bearing end 61 of the dampening cylinder. This adjustable mounting allows an independent adjustment of the dampening cylinders to ensure a smooth operation. Additionally, this allows slight modifications which may be required for slightly different individual toilet dimensions.

Figure 9:
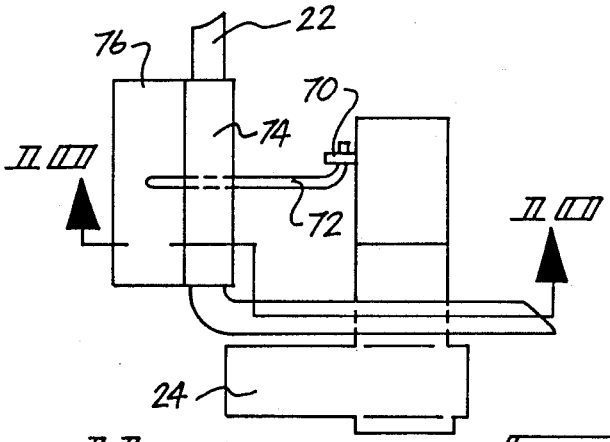
FIG. 9 is a cut away top detail view illustrating the cable actuating mechanism secured to the toilet tank.

FIG. 9 provides a partial top view of the conventional toilet tank 22 and flushing lever 24. A cable actuation bracket 74 is received over a side wall of the toilet tank 22. The lid of the toilet is of course removed for this operation. After the cable actuation bracket 74 has been installed, the toilet tank lid may be replaced. A cable 72 is connected via an attachment loop 70 to the inner portion of the flushing lever 24. A slider 76 on the bracket 74, moves vertically, in response to actuation of the flushing lever 24.

Figure 10:
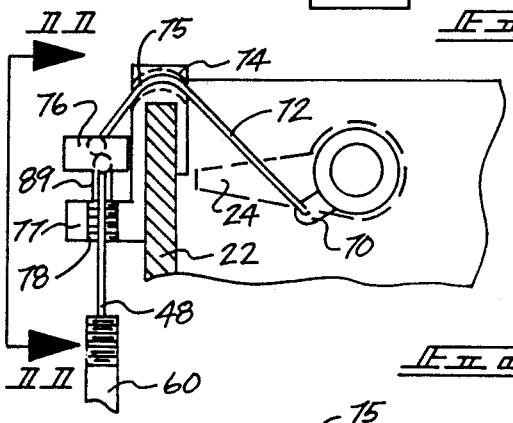
FIG. 10 is a partial cross sectional view, taken along line 10—10 of FIG. 9, further illustrating the cable actuating mechanism.

As shown in FIG. 10, the cable 72 extends through a slot or passage 75 in the bracket 74 and is secured to the upper portion of the slider 76. The slider 76 includes a guide tab 89 which cooperates with a slot formed in a lower portion 77 of the bracket 74. A threaded end portion of the cable sheath 60 is secured in a threaded aperture 78 in the lower bracket portion 77. The cable 48 is secured to the slider 76.

Figure 11:
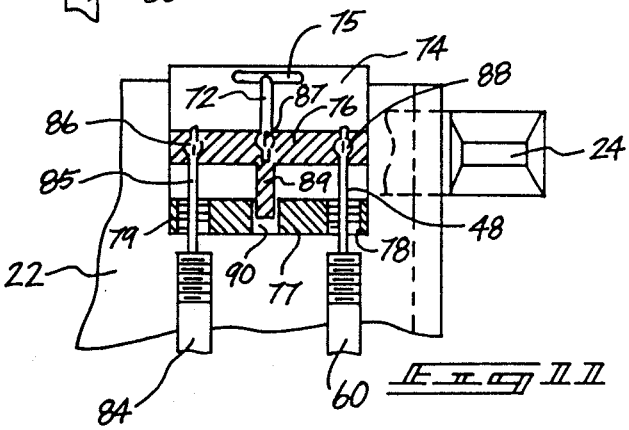
FIG. 11 is a further cross sectional illustration, taken along line 11—11 of FIG. 10, illustrating the construction of the cable actuating mechanism.

FIG. 11 provides a further illustration of the cable actuation bracket 74. The second cable sheath 84 has a threaded upper end portion configured for engagement with a second threaded aperture 79 provided in the lower portion 77 of the bracket 74. The guide projection 89 of the slider 76 is received within a slot or aperture 90 and is guided thereby for reciprocal vertical sliding movement. Upon actuation of the flushing lever 24, the cable 72 is tensioned, causing the slider 76 to move vertically upwardly. The cable 72 is secured by a conventional threaded fastener 87 to the slider 76 and the cables 48 and 85 are secured by respective fasteners 88 and 86. Upward vertical movement of the slider 76 causes a tensioning of the cables 48 and 85, which results in a disengagement of the locking pin 38 from the groove 34 as illustrated in FIGS. 5 and 7. Thus, upon actuation of the flushing lever 24, the toilet lid 16 and toilet seat 14 will be biased to a closed position by spring 26 (FIG. 1) at a rate controlled by the dampening cylinders illustrated in FIG. 3. It should be noted that the dampening cylinders utilized in the present invention may be of either a hydraulic or pneumatic type, without departing from the scope of the present invention.

Figure 12:
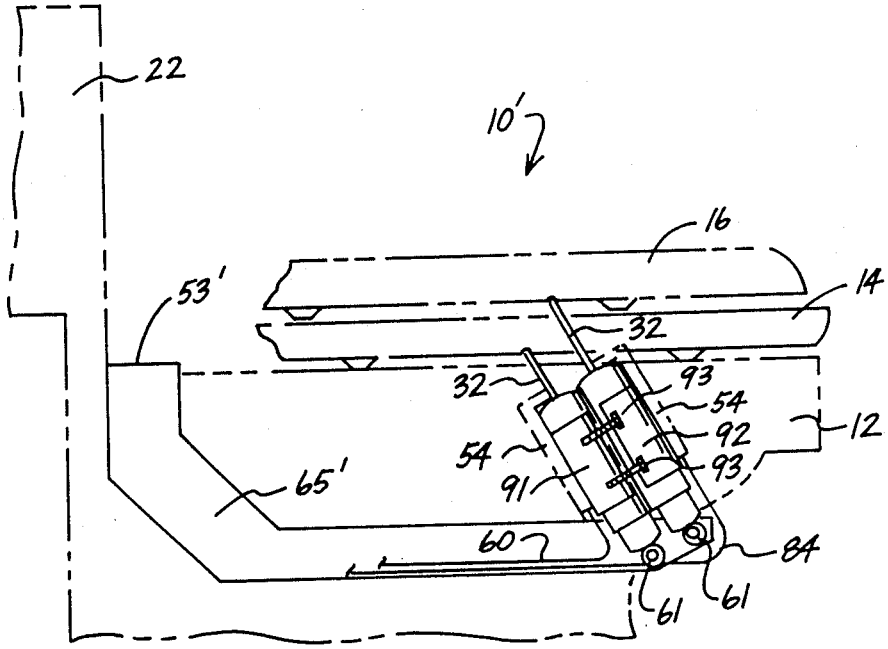
FIG. 12 is a diagrammatic illustration of a second embodiment of the present invention.

FIG. 12 illustrates a slightly modified second embodiment 10' of the present invention, in which the channel bracket 53' has a single downwardly extending support leg 65' which supports both of the dampening cylinders on the same side of the toilet. The dampening cylinders are secured together by a pair of U-shaped brackets 91 and 92 secured on both sides by threaded fasteners 93. The previously described locking pin mechanisms 54 are provided on each of the cylinders. This construction disposes both of the dampening cylinders in a compact arrangement on a single side of the toilet.

Figure 13:
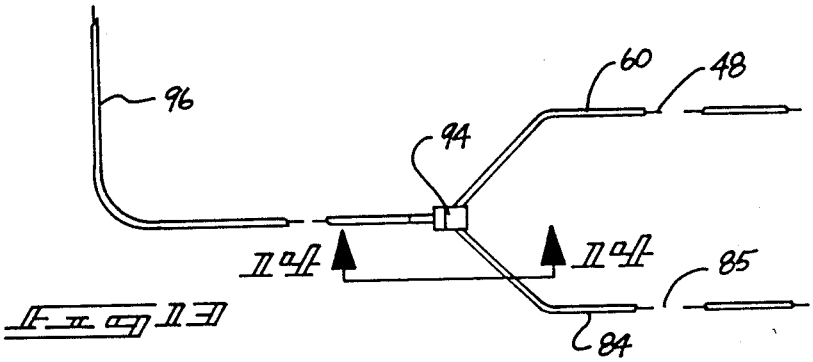
FIG. 13 is a diagrammatic illustration of the cable harness utilizing the second embodiment of the present invention.

FIG. 13 illustrates a control cable assembly for use with the modified form of the invention illustrated in FIG. 12. The cables 60 and 84 are formed by opposite ends of a single length of cable passing through a loop 94 which is secured to a sheathed cable 96 which extends to a cable actuation bracket of the type illustrated in FIG. 11.

Figure 14:
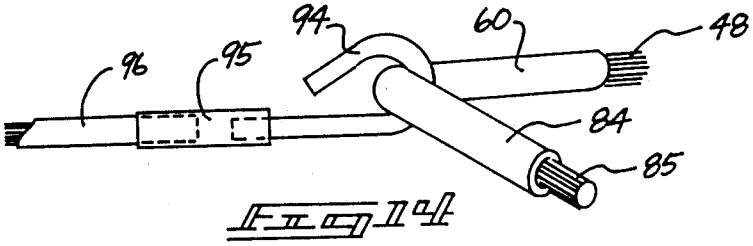
FIG. 14 is a side view, partially cut away, taken along line 14—14 of FIG. 13, further illustrating the details of the cable harness.

As shown in FIG. 14, the cable 96 causes a simultaneous actuation of both of the cable 60 and 84.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination with a toilet including a generally vertical tank with a flushing lever, a bowl, a seat, and an overlying lid pivotally mounted by a hinge pin, a toilet lid closing device comprising:

spring means biasing said lid and said seat to a closed position;

a channel bracket having an elongated mounting surface, a pair of parallel support legs perpendicularly attached at opposite ends of said mounting surface;

said mounting surface secured on said toilet adjacent said hinge pin;

an elongated slot formed in each of said support legs;

a pair of spindles, each extending through one of said slots;

an L-shaped bracket, on each of said spindles, each having a circular aperture receiving one of said spindles, said L-shaped brackets each having a first leg extending in parallel overlying relation with said support leg and a second transverse leg extending adjacent an end of said support leg;

a stop screw extending through each of said L-shaped bracket transverse second legs for abutment with one of said support leg ends;

a first dampening cylinder secured between one of said support legs and said seat for controlling closure of said seat;

a second dampening cylinder secured between the other of said support legs and said lid for controlling closure of said lid;

locking pin means on at least said dampening cylinder secured to said seat for retaining said lid and said seat in an open position; and cable means operatively connected for disengaging said locking pin means upon actuation of said flushing lever.

2. The combination of claim 1, wherein each of said dampening cylinders have a first end pivotally mounted on one of said spindles.

3. The combination of claim 1, wherein said spring means comprises:

a torsional coil spring received around said hinge pin, one end of said spring secured to said toilet and an opposite end of said spring secured to said lid and biasing said lid and said seat to a closed position.

4. In combination with a toilet including a generally vertical tank with a flushing lever, a bowl, a seat, and an overlying lid pivotally mounted by a hinge pin, a toilet lid closing device comprising:

spring means biasing said lid and said seat to a closed position;

a bracket secured adjacent to said hinge pin;

dampening cylinder means mounted on said bracket and having at least one extensible rod operatively connected for controlling closure of said seat and lid;

locking pin means on said dampening cylinder means for retaining said lid and said seat in an open position;

said extensible rod having a circumferential groove for engagement with said locking pin means; and cable means operatively connected for disengaging said locking pin means from said circumferential groove upon actuation of said flushing lever.

5. The combination of claim 4, further comprising spring means biasing said locking pin means into engagement with said circumferential groove.

6. The combination of claim 4 wherein said cable means comprises:

a cable actuating bracket secured on a side wall of said tank, said cable actuating bracket having a pair of threaded apertures securing threaded end portions of cable sheaths;

a slider mounted for linear reciprocal movement on said bracket, end portions of said cables secured to said slider; and an actuating cable extending between said flushing lever and said slider for releasing said locking pin means upon actuation of said flushing lever.

7. The combination of claim 4, wherein said spring means comprises:

a torsional coil spring received around said hinge pin, one end of said spring secured to said toilet and an opposite end of said spring secured to said lid and biasing said lid and said seat to a closed position.

8. In combination with a toilet including a generally vertical tank with a flushing lever, a bowl, a seat, and an overlying lid pivotally mounted by a hinge pin, a toilet lid closing device comprising:

spring means biasing said lid and said seat to a closed position;

a bracket secured adjacent to said hinge pin;

dampening cylinder means mounted on said bracket and having at least one extensible rod operatively connected for controlling closure of said seat and lid;

locking pin means on said dampening cylinder means for retaining said lid and said seat in an open position;

a cable actuating bracket secured on a side wall of said tank, said cable actuating bracket having at least one threaded aperture, at least one cable sheath having a threaded end portion secured in said aperture, said cable sheath having a slidable cable therein;

a slider mounted for linear reciprocal movement on said bracket, a first end portion of said cable secured to said slider, an opposite end portion of said cable secured to said locking pin means; and an actuating cable extending between said flushing lever and said slider for releasing said locking pin means upon actuation of said flushing lever.

9. The combination of claim 8, wherein said dampening cylinder means comprises a first dampening cylinder connected to said lid and a second dampening cylinder connected to said seat.

10. The combination of claim 8, wherein said spring means comprises:

a torsional coil spring received around said hinge pin, one end of said spring secured to said toilet and an opposite end of said spring secured to said lid and biasing said lid and said seat to a closed position.

* * * * *